PNEUMATIC SYSTEM FOR CONVEYING GRANULAR MATERIAL

CROSS REFERENCE TO RELATED APPLICATIONS

This application is related to application Ser. No. 681,307 filed Apr. 29, 1976 now U.S. Pat. No. 4,091,968 and owned by the assignee of the subject application.

BACKGROUND OF THE INVENTION

1. Field of the Invention

The invention relates generally to pneumatic conveying and dispensing systems and more particularly, to a field-going machine for applying granular chemicals to crop rows especially in combination with a pneumatic seed planter.

2. Prior Art

It is old in the art to dispense seeds or the like from a central hopper to a plurality of tubes by an air stream. Such is shown in U.S. Pat. Nos. 3,804,036 and 3,189,230. The use of an air stream as a material conveyor is shown in a more simple context in U.S. Pat. No. 2,941,842.

Practical problems with such devices would arise in areas of adaptability to a variety of materials to be dispensed. Considerations of adaptability may involve the need for controls which permit the operator to preselect, maintain and/or change operational characteristics from material-to-material. Another practical problem would relate to efficiency of application of the chemical—not only the efficiency as denoted by a variable overall rate of application (note deflector 49 in the '230 patent)—but more precisely to maintain an efficient and uniform rate of application for each row.

A further practical problem in dispensing granular chemicals pneumatically is that the material can attain a moisture content conducive to the formation of lumps. The conveying air stream in itself may not be sufficient to break up the lumps. Accordingly, blockage or intermitent nonuniform flow rates may result. A typical solution to such a problem is to incorporate a mechanical agitator within the hopper to break up the material so that the same will flow uniformly into the air stream. Of course, all mechanical systems are subject to wear, repair and replacement.

SUMMARY

The invention provides a machine for pneumatically metering, conveying and distributing granular material utilizing controls which provide efficient distribution of a variety of materials. A specific form of the invention provides a known pneumatic planter with a chemical distribution system powered exclusively by the air source of the planter with no interference with the planter's operation. The chemical distribution system includes a unique discharge assistant functional at the air-material interface to increase the efficiency of the system. Means are included for varying the output of the discharge assistant in response to varying the discharge rate of the material. Further control means are included for correlating the operation of the chemical distribution system to the starting and stopping of the planting operation.

Briefly, the objects of the invention are to provide a pneumatic metering, conveying and distributing system: effective to dispense a variety of granular materials; including controls enabling the operator to vary the overall rate of delivery of material as well as varying the delivery rate in a plurality of delivery paths; capable of dispensing material without requiring mechanical agitators or the like; providing uniform distribution rates; and usable in combination with a pneumatic seed planter whose source of air under pressure is the sole means for powering the system—all without adversely effecting operation of the planter.

BRIEF DESCRIPTION OF THE DRAWINGS

FIG. 7 is an enlarged fragmentary view taken in the direction of arrows 7—7 of FIG. 4;

FIG. 8 is an enlarged fragmentary view taken in the direction of arrows 8—8 of FIG. 3;

FIG. 9 is an enlarged fragmentary view of a portion of FIG. 5;

FIG. 10 is an enlarged fragmentary view of control valve structure of FIGS. 4 and 5;

FIG. 11 is an enlarged sectional view taken in the direction of arrows 11—11 of FIG. 1;

FIG. 12 is an enlarged elevation view of the material spreaders or banders of FIGS. 1 and 2; and FIG. 13 is a schematic view of the electrical control system of the invention.

DESCRIPTION OF THE PREFERRED EMBODIMENT

Figure 1:
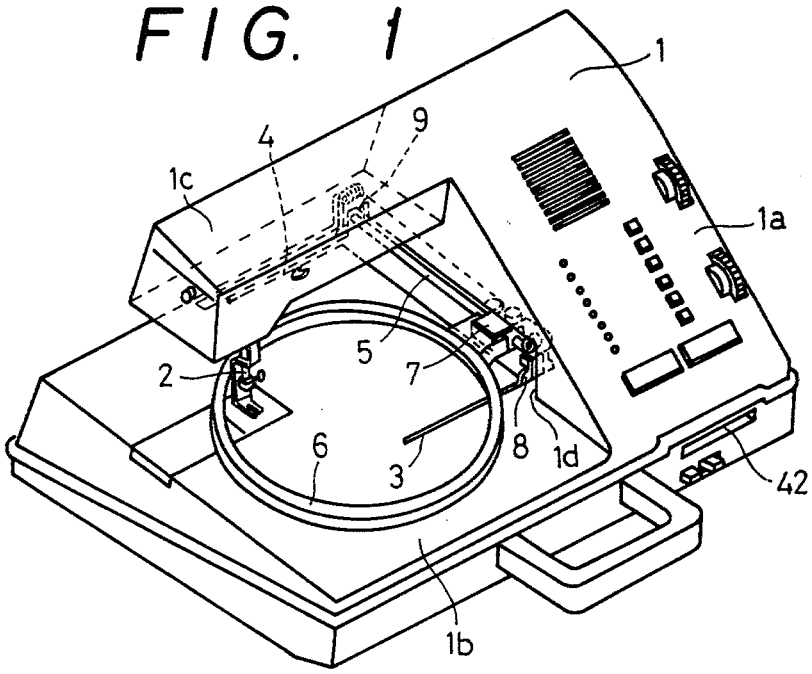
FIG. 1 is a plan view of a tractor-mounted pneumatic planter incorporating the granular material applicator of the invention.
Figure 2:
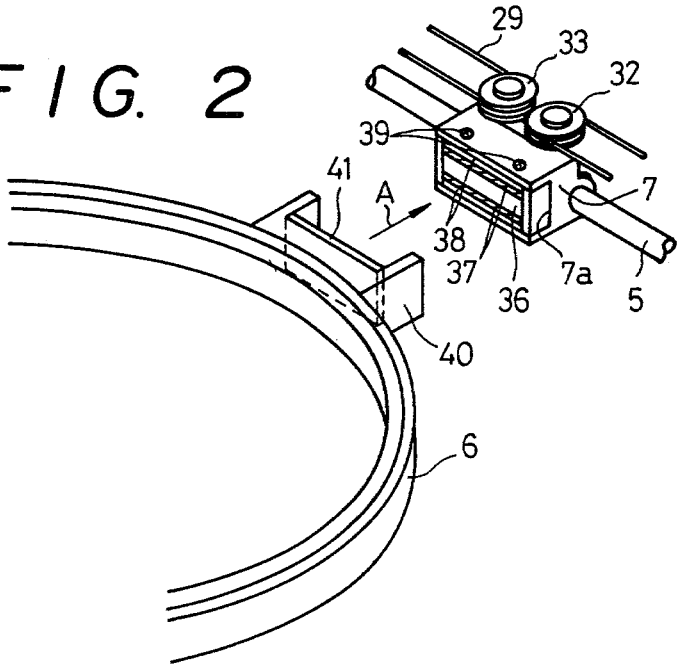
FIG. 2 is a rear elevation view of the planter and apparatus of FIG. 1.

Referring first to FIGS. 1 and 2 a pneumatic planter 10 is shown coupled to an agricultural type tractor 12. In practice the planter 10 includes a tool bar 14 of rectangular hollow section connected directly to a three point hitch 16 of the well known type associated with modern agricultural tractors. The planter 10 is thus of the so-called "fully mounted" type movable between raised transport and lowered planting positions by actuation of the three point hitch 16. The planter 10 is of the type marketed by the assignee of this application under the name CYCLO. As such it includes a central seed dispenser unit 18 mounted on the tool bar 14 for pneumatically delivering seeds through tubes (not shown) to a plurality of seed planting assemblies 20 mounted in uniformly spaced relation on the tool bar 14. Gauge wheels 22 may be secured on the tool bar 14 for ground support of the planter during operation.

The dispenser unit 18 is constructed and operated as shown in more detail in U.S. Pat. No. 3,885,704. The unit includes a seed hopper 24 equipped for gravity feeding of seeds into a rotatable seed drum 26 into which air under pressure is introduced by a blower fan 28. The fan 28 is mounted within a generally cylindrical housing 30 from which air is directed into the seed drum 26 through a conduit 32 best shown in FIG. 3. The seed planting units 20 are of conventional construction including furrow openers 34 and press wheels 36 all supported for vertical movement relative to the tool bar 14

AUTOMATIC EMBROIDERY SEWING MACHINE

BACKGROUND OF THE INVENTION

The invention relates to an automatic embroidery sewing machine, and in particular, to a drive mechanism associated with an embroidery frame thereof and an arrangement therefor.

An automatic embroidery sewing machine is known which includes a mechanism utilizing a plurality of servo motors and transmission assemblies for driving a support member which carries an embroidery frame in two directions of X- and Y-axis on the two dimensional X-Y plane and which also includes an electrical control unit for driving the mechanism in accordance with data contained in a magnetic tape, paper tape, card or semiconductor memory, etc. A variety of transmission assemblies are known which may be used in sewing machines of this kind to transmit the rotation of a servo motor to a support associated with an embroidery frame. Many of these transmission assemblies employ a combination of rack and pinion or other gear meshing assembly, producing offensive noises in operation in certain instances. In some instances, a backlash may cause an unsatisfactory accuracy of control.

To avoid this difficulty, there has been proposed the use of a combination of rollers and a wire for the power transmission assembly. However, in these proposals, a support member associated with an embroidery frame is either disposed rearwardly of the arm, to the left of the arm end or on the opposite side from the body of the sewing machine, or at a location remote from the body of the sewing machine, resulting in an increased overall size of the machine. In addition, a mechanism which drives the support member associated with the embroidery frame in the directions of the X- and Y-axis includes a number of parts which remain exposed around the bed, presenting an unsightly appearance. Because the embroidery frame is secured to the support member by set screws, a troublesome operation is required to mount or dismount the embroidery frame onto or from the sewing machine.

It will be seen that it is desirable to provide a compact mechanism which drives the support member associated with the embroidery frame, thus affording a sightly and neat appearance of the sewing machine. It is also desirable that the number of parts of the mechanism which remain exposed on or around the bed be minimized and that the mounting or dismounting of the embroidery frame onto or from the support member be simplified.

It is a first object of the invention to provide an automatic embroidery sewing machine in which a mechanism for driving a support member associated with an embroidery frame is neatly housed below a bed.

It is a second object of the invention to provide a compact, automatic embroidery sewing machine including a mechanism which drives a support member associated with an embroidery frame and which includes a reduced number of parts which remain exposed on or around the bed.

It is a third object of the invention to provide an automatic embroidery sewing machine having a neat appearance which is achieved by allowing a support member associated with an embroidery frame and a mechanism which drives it have all of their parts housed within the body of a sewing machine whenever an embroidery frame is dismounted from the support member.

It is a fourth object of the invention to provide an automatic embroidery sewing machine having a support member on which an embroidery frame can be easily mounted or dismounted.

SUMMARY OF THE INVENTION

One or more of these and other objects are achieved by providing at least one slit opening formed in the upper surface of the bed of a sewing machine so as to extend parallel to an arm shaft. At least one X-axis guide member is disposed below the bed so as to extend parallel to the slit opening, and the bottom of at least one carrier is slidably coupled with the guide member while at least one Y-axis guide member is fixedly connected to the head of the carrier which extends through the slit and is exposed above the bed. A support member associated with an embroidery frame is slidably coupled with the Y-axis guide member. An X-axis drive system comprises a motor, a plurality of rollers and a wire. Similarly, a Y-axis drive system comprises a motor, a plurality of rollers and a wire. Most portion of the both drive systems is disposed below the bed. A plurality of rollers are pivotally mounted on the head of the carrier and the support member, and the wires extend therearound.

In a preferred embodiment, an upright surface of the arm support which is contiguous with the upper surface of the bed or which extends in a direction perpendicular to the length of the slit opening is formed with a recess in which the head of the carriers, members secured to the head, the support member for the embroidery frame and the wires, all of which are exposed above the bed, can be entirely received. One end of the slit openings may extend deep into the recess as required, in order to guide these members into the recess. A permanent magnet is fixedly mounted on one of the support member and the embroidery frame while a magnetizable material or a permanent magnet is fixedly mounted on the other, thereby allowing a magnetic attraction acting therebetween to connect the embroidery frame integrally with the support member.

DESCRIPTION OF THE DRAWINGS

Figure 3:
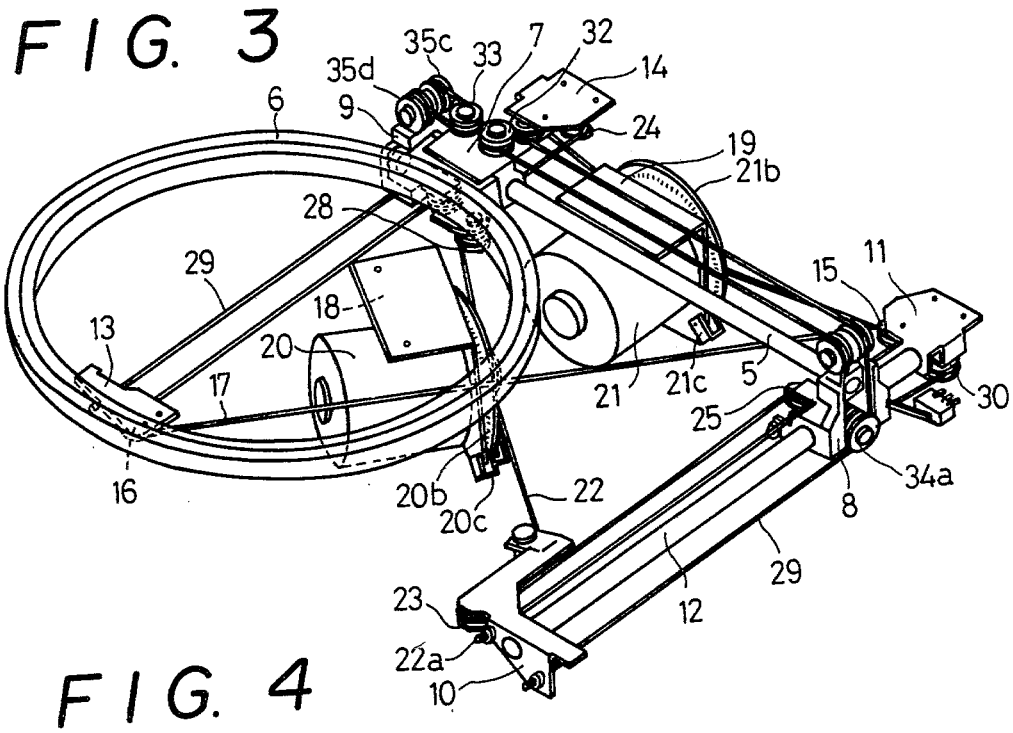
FIG. 3 is a fragmentary elevational view taken in the direction of arrows 3—3 of FIG. 2.
Figure 4:
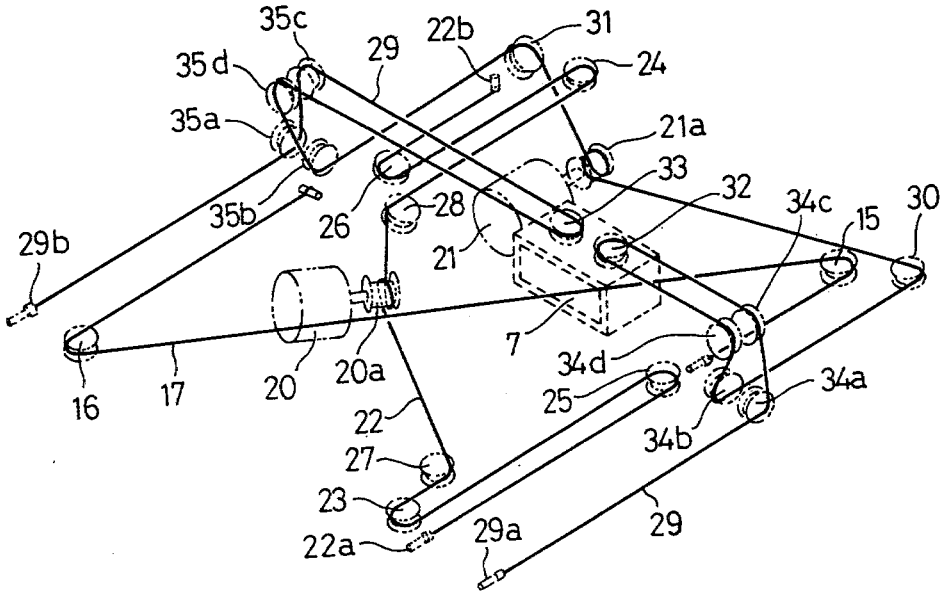
FIG. 4 is an enlarged elevation taken in the directions of arrows 4—4 of FIG. 2.
Figure 5:
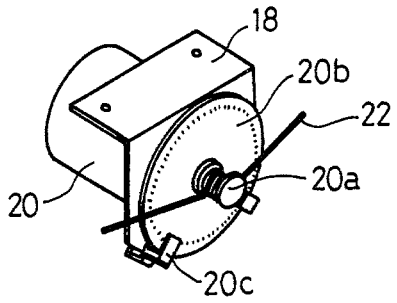
FIG. 5 is a side elevation view of the structure of FIG. 4.
Figure 6:
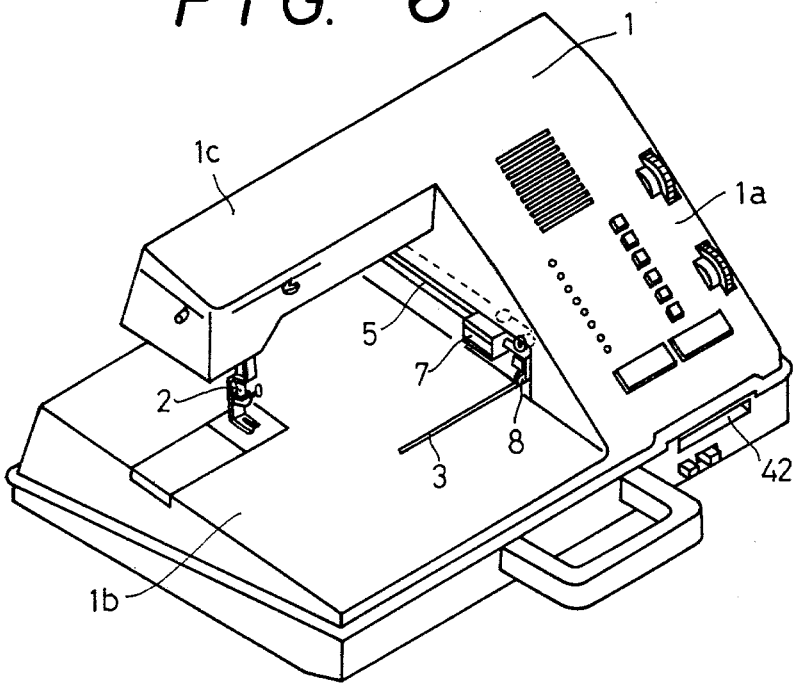
FIG. 6 is an enlarged sectional view taken in the direction of arrows 6—6 of FIG. 5.

The accompanying drawings illustrate a preferred form of the invention, in which:

FIG. 1 is a front perspective view of a sewing machine to which this invention has been applied;

FIG. 2 is an enlarged perspective view of part of the machine shown in FIG. 1, illustrating an embroidery frame detached from a traveller;

FIG. 3 is a perspective view of a drive mechanism associated with the traveller, with a bed removed;

FIG. 4 is a simplified diagram of the drive mechanism associated with the traveller, principally illustrating the loops of wires;

FIG. 5 is an enlarged perspective view of a servo motor shown in FIG. 3; and FIG. 6 is a front perspective view of the sewing machine shown in FIG. 1, illustrating a condition thereof for straight stitch sewing operation when the embroidery frame is removed.

DESCRIPTION OF PREFERRED EMBODIMENT

Referring to FIG. 1, there is shown a sewing machine 1 which is capable of performing a usual or regular sewing function. The machine includes a support or standard for an arm 1*c*, which support has an inclined front surface defining a control panel 1*a*. While not shown, a servo motor control circuit is housed within the support below the panel 1*a*, the control circuit operating to read and process an embroidery controlling data which is stored in or on a suitable record medium such as tape, in synchronized relationship with an elevating or oscillating motion of a needle bar 2 to drive a pair of servo motors for each stitch, thus imparting a movement to an embroidery frame 6 to trace a two-dimensional figure.

The machine includes a bed 1*b* which is formed with a pair of slits 3, 4 which extends in the lateral direction or in the direction of an X-axis and which are spaced apart forwardly and rearwardly. a Y-axis guide rod 5 extends over the bed 1*b* to bridge across the slits 3, 4 in a direction perpendicular thereto. An embroidery frame drive means is housed within the bed 1*b* which causes a translational movement of the Y-axis guide rod 5 along the slits 3, 4 while maintaining its perpendicular relationship with the latter and which also causes a sliding movement of a traveller 7 carried on the Y-axis guide rod 5 in a fore-and-aft direction or in the direction of the Y-axis. The purpose of the traveller 7 is to carry the embroidery frame 6 in a detachable manner. On its opposite ends, the Y-axis guide rod 5 has front and rear carriers 8, 9 mounted thereon, the lower ends of which extend through individual slits 3, 4, to be supported within the bed 1*b* so as to be slidable along slits 3, 4, as will be further described later. The support for the arm also serves as a casing for the control panel 1*a*. An upright surface of the casing which is contiguous with the surface of the bed 1*b* is formed with a recess which is capable of entirely receiving the front and rear carriers 8, 9, their supporting Y-axis guide rod 5 and the traveller 7. In FIG. 1, the recess is shown as a pocket 1*d*, and the right-hand end of each slit 3, 4 extends deep into the pocket 1*d* in order to permit the both carriers 8, 9 to be introduced within the pocket 1*d*.

Referring to FIG. 2, the end face of the traveller 7 is formed with a recess 7*a* in which a magnet 36 is received. The magnet 36 is magnetized in the vertical direction, as viewed in this Figure, and is held between the both limbs of a yoke plate 37 of a magnetizable material. The resulting construction is covered by a protective plate 38 of a synthetic resin and is fitted into the recess 7*a* where it is ingegrally secured to the traveller 7 by set screws 39. It is preferred that the magnet 36 be mounted in the traveller 7 so that the both limbs of the yoke plate 38*a* project slightly beyond the open end faces of the traveller 7.

As is conventional, the embroidery frame 6 comprises a pair of inner and outer rings between which a cloth to be worked is passed and is maintain in a taut manner. At a point along its periphery, the outer ring is provided with an adaptor 40 having a channel-shaped cross section which has an opening of a width to receive the traveller 7 therein. The adaptor 40 may be formed integrally with the outer ring, or a separate adaptor may be secured thereto by suitable means. On its inner surface, the base of the adaptor 40 has an absorber 41 of a magnetizable material either adhesively or otherwise secured thereto.

Conveniently, a cloth to be worked is mounted on the embroidery frame 6 when it is dismounted from the sewing machine 1. In certain circumstances, a plurality of embroidery frames 6 may be provided, some or all of which may be loaded with cloths to improve the operating efficiency. The embroidery frame 6 thus prepared is moved in a direction indicated by an arrow A shown in FIG. 2 to be coupled with the traveller 7, whereupon the absorber 41 is held attracted to the yoke plate 37, thus closing a magnetic circuit through the magnet 36. In this manner, the embroidery frame 6 is firmly held againt the traveller 7. Referring to FIG. 1, when a movement is imparted to the embroidery frame 6 having an X-axis component which results from a lateral movement of the Y-axis guide rod 5 along the slits 3, 4 and also having a Y-axis component which results from a movement of the traveller 7 along the guide rod 5, there is achieved a composite motion which traces a desired two-dimensional figure. To add, this movement of the embroidery frame 6 takes place in timed relationship with the elevating and oscillating motion of the needle bar 2 and during an upper half cycle thereof when the needle is disengaged from the cloth and located above it.

Referring to FIG. 3 for a more close description of the manner in which each of the carriers 8, 9 is supported within the bed 1*b*, a pair of left- and right-hand front bracket 10, 11 are fixedly mounted below the bed in alignment with the left- and right-hand end of the front slit 3. These brackets support the opposite ends of an X-axis guide rod 12 in parallel relationship with the front slit 3. One of the carriers, 8, is supported on and guided by the X-axis guide rod 12 in a slidable manner. A corresponding guide rod is not disposed below the other or rear carrier 9. However, if required, a combination of a small wheel and a rail therefor may be disposed below the bed 1*b* for cooperation with the rear carrier.

As the front carrier 8 slides laterally along the X-axis guide rod 12, the Y-axis guide rod 5 maintains its perpendicular relationship with the sliding direction. At this end, means is provided which links the front and the rear carrier 8, 9 for integral movement along the slits. Specifically, left- and right-hand rear brackets 13, 14 are mounted within the bed 1*b* in alignment with the opposite ends of the rear slit 4. Idlers 16, 15 are pivotally mounted on the left-hand rear bracket 13 and the right-hand front bracket 11, respectively, and a wire 17 extends around these idlers and has its opposite ends anchored to the front and rear carriers 8, 9, thus following a Z-shaped path. In this manner, the wire 17 is effective to produce an integral movement of the both carriers 8, 9 in the same direction if a tractive force is applied to either carrier.

Referring to FIG. 4, a drive force which is utilized to drive the front and rear carriers 8, 9 along the slits 3, 4 and thus in the direction of the X-axis, and to drive the traveller 7 along the Y-axis guide rod 5 in the direction of the Y-axis, at a level above the bed 1*b*, utilizing the carriers 8, 9 as relay means will now be described. A space is defined within the bed 1*b* by four brackets 10, 11, 13 and 14, in which an X-axis servo motor 20 and a Y-axis servo motor 21 are supported on respective motor brackets 18, 19 which are fixedly mounted in a suitable manner. These servo motors 20, 21 cooperate with individual wires to drive the traveller 7 in both directions of the X- and Y-axis. Initially considering a motion transmitting mechanism which provides an X-axis component of the motion, an X-axis drive wire 22 is wound, in its intermediate portion, around an X-axis capstan roll 20*a* which is mounted on an output shaft of the X-axis servo motor 20 so as to be driven in either direction depending on the rotation of the capstan. When the drive wire 22 is driven in either direction, for example, in the direction toward the viewer, as viewed in FIG. 4, at a point adjacent to the capstan, the rear carrier 9 will be driven closer to the right-hand rear bracket 14. When the wire is driven in the opposite direction, the front carrier 8 will be driven closer to the left-hand front bracket 10. Since the front and the rear carrier 8, 9 are connected together by the wire 17 to move in an integral manner, the Y-axis guide rod 5 slides in the lateral direction or in the direction of the X-axis in response to a drive from the X-axis motor 20 while maintaining its perpendicular relationship with respect to the slits 3, 4.

A transmission mechanism which moves the front and the rear carrier 8, 9 closer to their corresponding bracket in response to a drive imparted to the X-axis drive wire 22 will be readily apparent from an inspection of FIG. 4, and can be said as comprising a pair of pulley assemblies each including a fixed pulley and a movable pulley and disposed to rotate in the horizontal plane, with both assemblies acting in the opposite directions and with their input end connected together at the capstan. Specifically, fixed idle rolls 24, 23 which correspond to the fixed pulleys are pivotally mounted on the right-hand rear bracket 14 and the left-hand front bracket 10, respectively, and movable idle rolls 25, 26 which correspond to the movable pulleys are pivotally mounted on the front and the rear carrier 8, 9, respectively. The opposite ends 22*a*, 22*b* of the X-axis drive wire 22 are anchored to the right-hand rear bracket 14 and the left-hand front bracket 10, respectively. A guide roll 27 pivotally mounted on the left-hand front bracket 10 and another guide roll 28 which is pivotally mounted within the bed 1*b* by means, not shown, are provided in order to transmit the drive from the X-axis capstan roll 20*a* to the fixed idler rolls 23, 24.

Considering a Y-axis drive wire 29, the associated transmission mechanism is similar to that associated with the X-axis drive wire 22 in that a pair of pulley assemblies are provided each including a fixed pulley and a movable pulley and disposed to rotate in the horizontal plane, with the both movable pulleys being pivotally mounted on the traveller 7 and acting in the opposite directions. However, there is a distinction in that the transmission mechanism associated with the X-axis component need only cause a translational movement of the Y-axis guide rod 5 in the lateral direction, while the Y-axis component of the movement of the traveller 7 must be achieved by causing it to slide in the direction of the Y-axis along the Y-axis guide rod 5 which undergoes a movement in the lateral direction. Accordingly, an arrangement is made such that the front and the rear carrier 8, 9 can be moved integrally in the lateral direction, irrespective of the movement and the position of the traveller 7 in the fore-and-aft direction. Specifically, intermediate its length, the Y-axis drive wire 29 is wound around a Y-axis capstan roll 21*a* which is mounted on an output shaft of the Y-axis servo motor 21. Fixed pulleys which cooperate with the wire are a fixed idler roll 30 pivotally mounted on the righthand front bracket 11 and a fixed idler roll 31 pivotally mounted on the right-hand rear bracket 14. Movable pulleys correspond to ilder rolls 32, 33 which are pivotally mounted on top of the traveller 7. The opposite ends 29*a*, 29*b* of the wire 29 are anchored to the left-hand front bracket 10 and the left-hand rear bracket 13, respectively. In order to permit a sliding motion of the Y-axis guide rod 5 in the lateral direction or in the direction of the X-axis without causing any movement of the traveller 7 in the fore-and-aft direction or in the direction of the Y-axis and to enable a movement of the traveller 7 in the fore-and-aft direction whenever the wire 29 is driven in either direction, four guide rolls 34*a*-34*d* and 35*a*-35*d* are disposed on each of the front and the rear carrier 8, 9 in the path of the wire 29 in order to define the path such that the traveller is pulled in opposite directions, perpendicular to the X-axis, by those portions of the wire which extend in the direction of the X-axis. While only two rolls will be sufficient to change the path of the wire at right angles, the four guide rolls are used in order to provide a portion of the wire which extends through the slits 3, 4, respectively.

As shown in FIG. 5, each of the servo motors 20, 21 has an A/D conversion disc 20*b*, 21*b* mounted on its output shaft in order to convert the rotation of the shaft into a corresponding digital quantity. A pickup 20*c*, 21*c* is fixedly mounted on each of the motor brackets 18, 19 to detect the amount of rotation to supply a feedback signal to an associated control circuit, not shown.

In operation, the embroidery frame 6 is mounted on the traveller 7 as illustrated in FIG. 1, and a cloth to be worked, not shown, is loaded on the embroidery frame 6 in a usual manner. By operating the control panel 1*a*, an internal control circuit, not shown, is activated. By way of example, if a magnetic tape cassette is utilized, it is inserted into the receptacle 42 formed in the bottom of the control panel 1*a*, and suitable switch may be operated, whereupon embroidery sewing data is written into a memory formed by an large scale integrated element which is also contained in the control panel 1*a*. The data is read and processed in synchronized relationship with an elevating motion of the needle bar, and the position of the embroidery frame for each stitch, as represented by its coordinates along the X- and Y-axis, is controlled in accordance with the programmed control data, thus energizing the corresponding servo motors 20, 21. The resulting rotation of the X-axis servo motor 20 is transmitted through the capstan roll 20*a* to the X-axis drive wire 22, which then causes the movable idler roll 25 on the front carrier 8 to be pulled to the left or causes the movable idler roll 26 on the rear carrier 9 to be pulled to the right. In either instance, the both carriers 8, 9 undergo a translational movement in the lateral direction to impart an X-component of the movement to the embroidery frame 6 above the bed, which is carried by the traveller 7, without causing any deviation of the Y-axis guide rod 5 from its fore-and-aft direction. Similarly, the rotation of the Y-axis servo motor 21 is transmitted to the Y-axis drive wire 29, which then operates to cause a sliding movement of the traveller 7 along the Y-axis guide rod 5 closer to either the front carrier 8 or the rear carrier 9, thus imparting a Y-axis component of the movement to the embroidery frame 6. The both components of the movement in the X- and Y-coordinate are independent from each other such that, for example, when the X-axis drive wire 22 is driven to move the Y-axis guide rod 5, the movable idler rolls 32, 33 rotate on the traveller 7, but this causes no sliding movement of the traveller 7 in the direction of the Y-axis unless the Y-axis drive wire 29 is also drive. As a consequence, the embroidery frame 6 follows or traces a two-dimensional figure which represents a composite of the both components of the movement. The embroidery stitching proceeds by controlling the rotation of the both servo motors 20, 21 acting in the X- and Y-axis direction in accordance with the programmed data for each stitch, during the one-half cycle thereof when the needle is disengaged from the cloth to be worked.

When it is desired to perform a straight stitching or regular operation other than the embroidery stitching with the sewing machine 1, the control panel 1*a* may be operated in suitable manner to activate the X-axis servo motor 20 so that the Y-axis guide rod 5 is moved to the right-hand end of the slits 3, 4, namely, into the pocket 1*d* formed in the sewing machine, where it remains at rest. When the embroidery fame 6 is detached from the traveller 7, nothing is left on the bed 1*b* which might interfere with the placing of a cloth to be worked thereon, as in a usual straight stitch sewing machine, such condition being illustrated in FIG. 6. It will also be noted that there is also nothing in the front and rear areas as well as in the left-hand areas of the bed 1*b* which might interfere with a handling of the cloth.

As discussed above, in the preferred embodiment of the invention, the pair of slits 3, 4 and formed in the bed surface of the sewing machine to extend parallel to each other and spaced from each other in the fore-and-aft direction. The guide rod 5 is disposed for translational movement in the lateral direction along these slots to produce an X-axis component of the movement. By causing a sliding movement of the traveller 7 along the guide rod 5, a Y-axis component of the movement is produced. The composite of the both components of the movement which are transmitted to the embroidery frame 6 traces a two-dimensional figure. With the drive mechanism, the guide rod 5 slides in the lateral direction without causing any relative shifting between its opposite ends. When the machine is not used for the purpose of performing an embroidery stitching, the guide rod 5 may be driven into the right-hand end of the slits 3, 4 and the traveller 7 may be detached from the embroidery frame 6, thus housing the frame supporting traveller 7 as well as its associated guide rod 5 within the pocket which is formed in the root of the arm support of the sewing machine. Hence, it will be seen that the sewing machine presents a compact and neat appearance as compared with a conventional type of sewing machines in which a frame support and drive mechanism which is substantially separate from the sewing machine is mounted on the table of the machine. When performing any operation other than the embroidery stitch, a usual stitching operation can be performed without requiring the dismounting of any part or all of the frame support mechanism.

Since various changes can be made in the above construction without departing from the scope of the invention, it is intended that all matters contained in the above description or shown in the accompanying drawings shall be interpreted as illustrative only and not limitative.

Having thus set forth the nature of the invention, what is claimed is:

1. In an automatic embroidery sewing machine including an X-axis drive system, a Y-axis drive system, and a support member coupled with both of these drive systems and supporting an embroidery frame; the improvement which comprises at least one slit opening formed in the upper surface of a bed of the sewing machine to extend in a lateral direction, at least one X-axis guide member disposed below the bed and extending in the lateral direction, a carrier extending through the slit opening and coupled with the X-axis guide member in a slidable manner at a point below the bed, a Y-axis guide member having its part fixedly connected with the head of the carrier which is exposed above the bed, and an embroidery frame support member coupled with the Y-axis guide member in a slidable manner, each of the X- and Y-axis drive system including a motor, a plurality of rollers and a wire, the wire of the X-axis drive system being coupled with the carrier, the wire of the Y-axis drive system being coupled with the support member through the carrier.

2. An automatic embroidery sewing machine according to claim 1 in which there are two slit openings which extend parallel to each other and in which there are two carriers each of which extends through the respective slit opening, one of the wires having its one end secured to one of the carriers and its other end secured to other carrier and extending around at least two rollers to define a Z-shaped path below the bed.

3. An automatic embroidery sewing machine according to claim 2 in which the X-axis drive system comprises a pair of rollers pivotally mounted on a portion of each carrier which is located below the bed, a single wire having its opposite ends anchored to stationary points and extending around said pair of rollers and other rollers which are utilized to define the path of the wire, and a single motor which drives the wire, the X-axis drive system being entirely disposed below the bed, and wherein the Y-axis drive system comprises a pair of rollers pivotally mounted on the respective carriers, a plurality of rollers pivotally mounted on the support member, a single wire having its opposite ends anchored to stationary points and extending around said rollers and other rollers which define the path of the wire, and a single motor which drives the wire, the motor, said other rollers and part of the wire of the Y-axis drive system being disposed below the bed.

4. An automatic embroidery sewing machine according to claim 1, further including a standard having a side contiguous with the upper surface of the bed and which is formed with a recess in which the members exposed above the bed including the head of the carrier, the support member associated with the embroidery frame and other parts secured thereto can be received, said slit opening extending into the recess.

5. An automatic embroidery sewing machine according to claim 1 in which the support member associated with the embroidery frame is provided with a permanent magnet for cooperation with a magnetizable material which is mounted on the embroidery frame to hold it by attraction.

6. An automatic embroidery sewing machine comprising a bed, a pair of slit openings formed in the upper surface of the bed and extending in a lateral direction and parallel to each other, a single X-axis guide rod disposed below the bed and extending parallel to the slit openings, a first carrier extending through one of the slit openings and coupled to the X-axis guide rod to be slidable thereon, a second carrier extending through the other slit opening, a Y-axis guide rod having its opposite ends secured to the first and the second carrier, a support member associated with an embroidery frame, the support member being slidably disposed on the Y-axis guide rod and having a permanent magnet secured thereto, a first wire having its opposite ends anchored to the first and the second carrier below the bed and extending along a Z-shaped path, an X-axis drive system disposed below the bed and including a plurality of movable rollers pivotally mounted on the first and the second carrier, a plurality of fixed rollers pivotally mounted on stationary parts, a second wire having its opposite ends anchored to stationary points and extending around the movable and fixed rollers, the fixed rollers defining a path for the second wire, and a motor for driving the second wire, a Y-axis drive system including a plurality of movable rollers pivotally mounted on lower parts of the carriers which are disposed below the bed, a plurality of movable rollers pivotally mounted on the head of the carriers which are disposed above the bed, a plurality of movable rollers pivotally mounted on the support member, a plurality of fixed rollers pivotally mounted on stationary parts below the bed, a third wire having its opposite ends anchored to stationary points below the bed and extending around the movable and fixed rollers, and another motor disposed below the bed for driving the third wire, and a recess formed in a side of a standard supporting a bracket arm which is contiguous with the upper surface of the bed, the recess being capable of receiving the carrier portions, the Y-axis guide rod, the support member and the rollers and wires coupled thereto which are exposed above the bed internally of the side of the standard.

* * * * *